US007066673B1

(12) United States Patent
Kuo

(10) Patent No.: US 7,066,673 B1
(45) Date of Patent: Jun. 27, 2006

(54) STRUCTURE OF A PEN

(76) Inventor: Rui-Feng Kuo, 1F., No. 37, Ren-ai St., Shulin City, Taipei County (TW)

( * ) Notice: Subject to any disclaimer, the term of this patent is extended or adjusted under 35 U.S.C. 154(b) by 0 days.

(21) Appl. No.: 11/100,079

(22) Filed: Apr. 7, 2005

(51) Int. Cl.
*A46B 11/00* (2006.01)
*B43K 27/02* (2006.01)
*A47L 11/08* (2006.01)

(52) U.S. Cl. ..... 401/39; 401/37; 401/11; 401/18

(58) Field of Classification Search ..... 401/18, 401/17, 19, 20, 34, 31, 21, 37, 39
See application file for complete search history.

(56) References Cited

U.S. PATENT DOCUMENTS 460,602 A * 10/1891 Stevens ..... 401/17
1,153,807 A * 9/1915 MacPherson ..... 401/34
1,683,485 A * 9/1928 Rall ..... 401/92
3,941,488 A * 3/1976 Maxwell ..... 401/17
5,638,566 A * 6/1997 Wu ..... 7/167

* cited by examiner

*Primary Examiner*—David J. Walczak
(74) *Attorney, Agent, or Firm*—Egbert Law Offices

(57) ABSTRACT

The pen structure includes the pen body that has a ball tip for the refill to protrude and the end that is far from the ball tip. The reversible accessory connected the end of the pen includes an extra functional end and a two-way terminal connector that is far from the extra functional end, and a slot that is placed at the end of the pen. When the reversible accessory is connected to the slot by the first terminal connector, it makes the extra functional end shown in the protruding position, and when the reversible accessory is connected to the slot by the second terminal connector, it makes the extra functional end shown in the hidden position. The pen may use its reversible accessory to increase its practicality and extra functions, and when the extra functional end is not used, the unit is shown in the hidden condition, which may keep the appealing appearance of the pen.

3 Claims, 7 Drawing Sheets

STRUCTURE OF A PEN

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a pen structure, and more particularly to a pen structure which has a reversible accessory at its end for both protruding or hidden positions.

BACKGROUND OF THE INVENTION

Currently, there are quite a few styles of pen on the market, and compared to the traditional, simple pen style, most of the pens of conventional design are added with more decoration, such as decorations at the end of the pen, to attract the customers and increase their desires to buy. However, for some consumers, the decoration is not the primary buying factor, the practicality is the consideration for pen selection.

Thus, to overcome the aforementioned problems of the prior art, it would be an advancement if the art to provide an improved pen structure that can significantly improve the efficacy.

To this end, the inventor has provided the present invention of practicability after deliberate design and evaluation based on years of experience in the production, development and design of related products.

BRIEF SUMMARY OF THE INVENTION

The effects of the present invention are as follows:

1. Providing a new pen structure that has a two-way reversible accessory at the end, it is a new component is first seen in the industry that meets the qualification for new patent.

2. With the reversible accessory, it helps the pen increasing its function by this special improved structure design. For instance, the brush type shown in FIGS. 1–6 in the present invention creates the practical and extra function such as cleaning the document, table and keyboard, and by so doing, it increases the function, practicality and added value of the pen.

3. When not using its extra functional end, it may be hidden by rearranging the unit, which can keep the beautiful look of the pen.

4. By putting the optical pen head feature on the first terminal connector of the reversible accessory to use the pen as the optical touch pen for computers, cellular phones and PDA, which creates more functions for the pen and meets the actual demand of today's consumers.

5. By using the extra functional end of the reversible accessory with the elastic structural design to make the extra functional end show protruding or hidden reversible accessory according to different directions used or placed.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
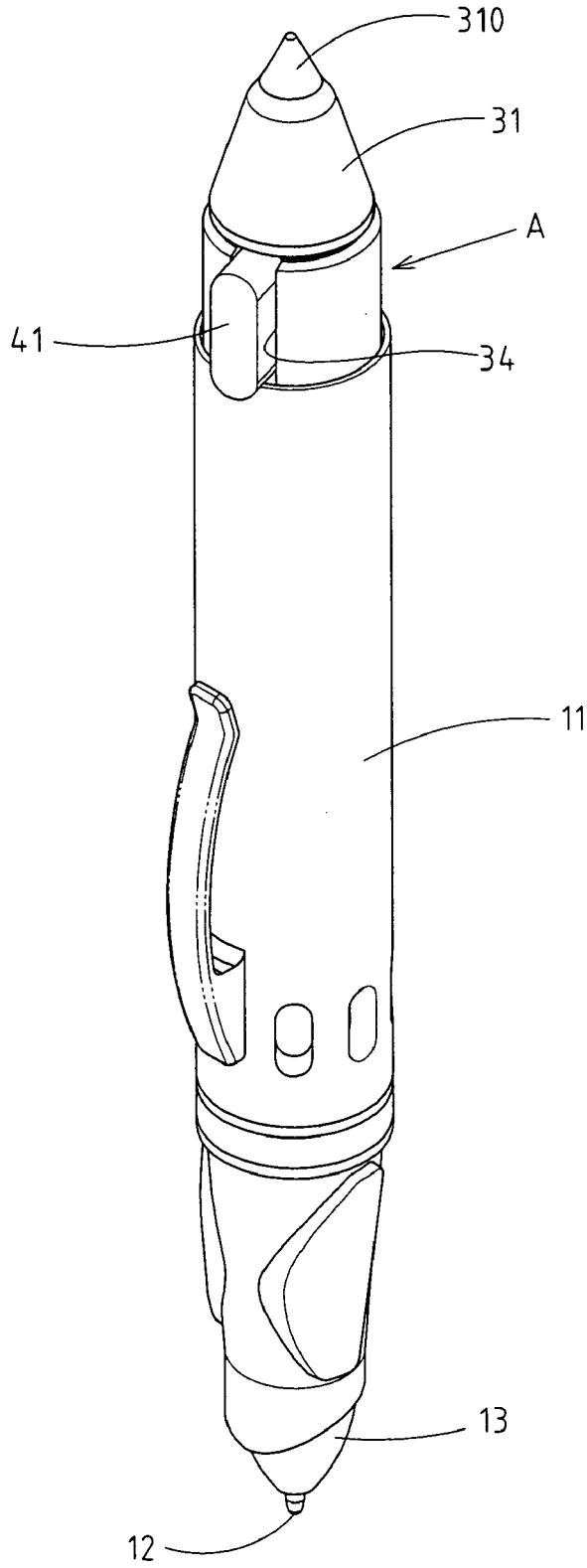
FIG. 1 shows a perspective view of the preferred embodiment of the present invention, with the extra functional end in the hidden position.

The features and the advantages of the present invention will be more readily understood upon a thoughtful deliberation of the following detailed description of a preferred embodiment of the present invention with reference to the accompanying drawings.

As shown in FIGS. 1–4, there is an improved pen structure embodied in the present invention.

The invention includes a pen body 11.

There is also a ball tip 13, which allows the refill 12 to protrude.

The invention has an end 14, which is far from ball tip 13.

The invention also has a slot 15, which is placed at the end 14.

There is a reversible accessory A that is connected to the slot 15 at the end 14 of pen, in which an extra functional end 20 and the first and second terminal connector 31, 32 that is far from the extra functional end 20 are included.

Whereas, the extra functional end 20 of this reversible accessory A can be an elastic structure. In this case, this extra functional end 20 is placed on one end of the inner slide 40, which defines a functional element and one side of the inner slide is shaped into a protruding button 41. A cannular slot 33 is placed on an inner slide structure inside the reversible accessory A for the inner slide 40 to slide in it, and a long guiding slot 34 is placed on one side of cannular slot 33 for said protruding button 41 to make the moving effect. The inner slide 40 is leaning toward one end of extra functional end 20, and there is an elastic accessory 50 (in this case, it is a spiral spring) set between the slide and the fixed point on the cannular slot, which makes supporting position a normal condition for inner slide 40, and makes the extra functional end 20 stay in the reversible accessory A under regular condition. When the reversible accessory A is connected in the slot 15 by the first terminal connector 31, it pushes the inner slide 40 outward along with the extra functional end 20 by pushing the protruding button 41 against the end 14 of the pen.

Another words, when using said reversible accessory A, its extra functional end 20 can be used in the protruding position or in the hidden position inside the slot 15 depend on the user's need.

The slot 15 of the pen and the first terminal connector 31 and the second terminal connector 32 of the reversible accessory A can set a corresponding fastening 16, 37 and 36, which helps the two connecting directions of the reversible accessory to be in a fixed position.

Figure 7:
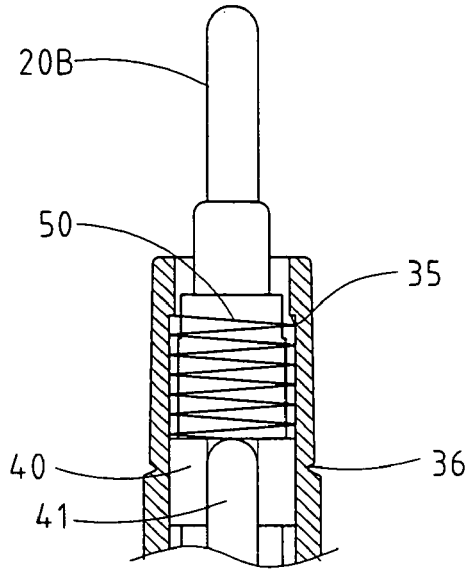
FIGS. 7–8 show partial sectional views of the operating of the embodiment of the extra functional end
Figure 8:
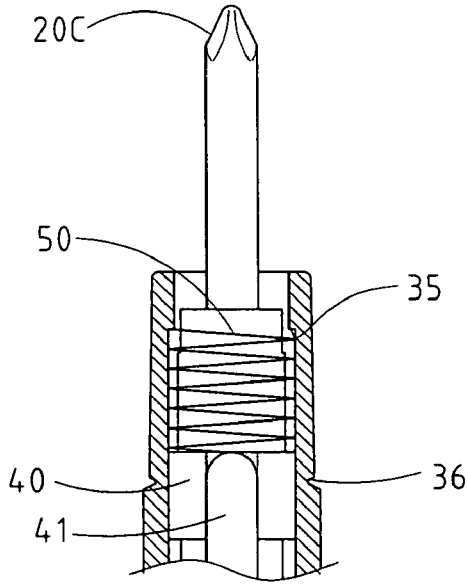

The extra functional end 20 of the reversible accessory may be: brush (shown in this embodiment), eraser (indicated in 20B of FIG. 7), writable pen head and the head of tool (indicated in 20C of FIG. 7) such as flat head and cross screwdriver).

An optical pen head 310 may be placed on the first terminal connector 31 of the reversible accessory A.

The design is made with the said structure, and the description of the instruction for the present invention is set forth as follows.

Figure 2:
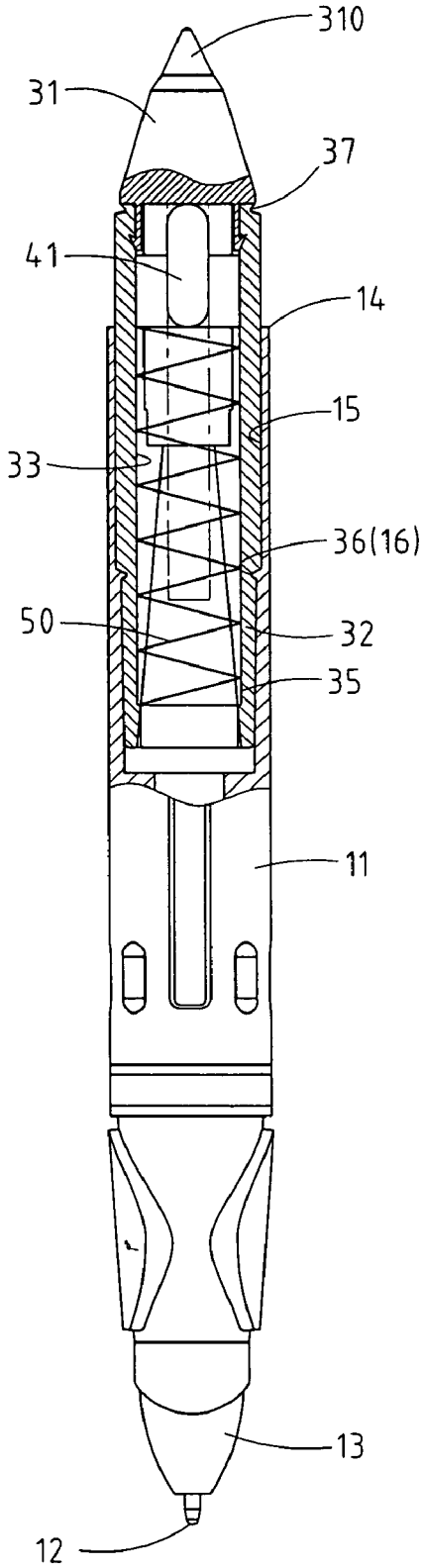
FIG. 2 shows a cross-sectional view of the preferred embodiment of the present invention.
Figure 3:
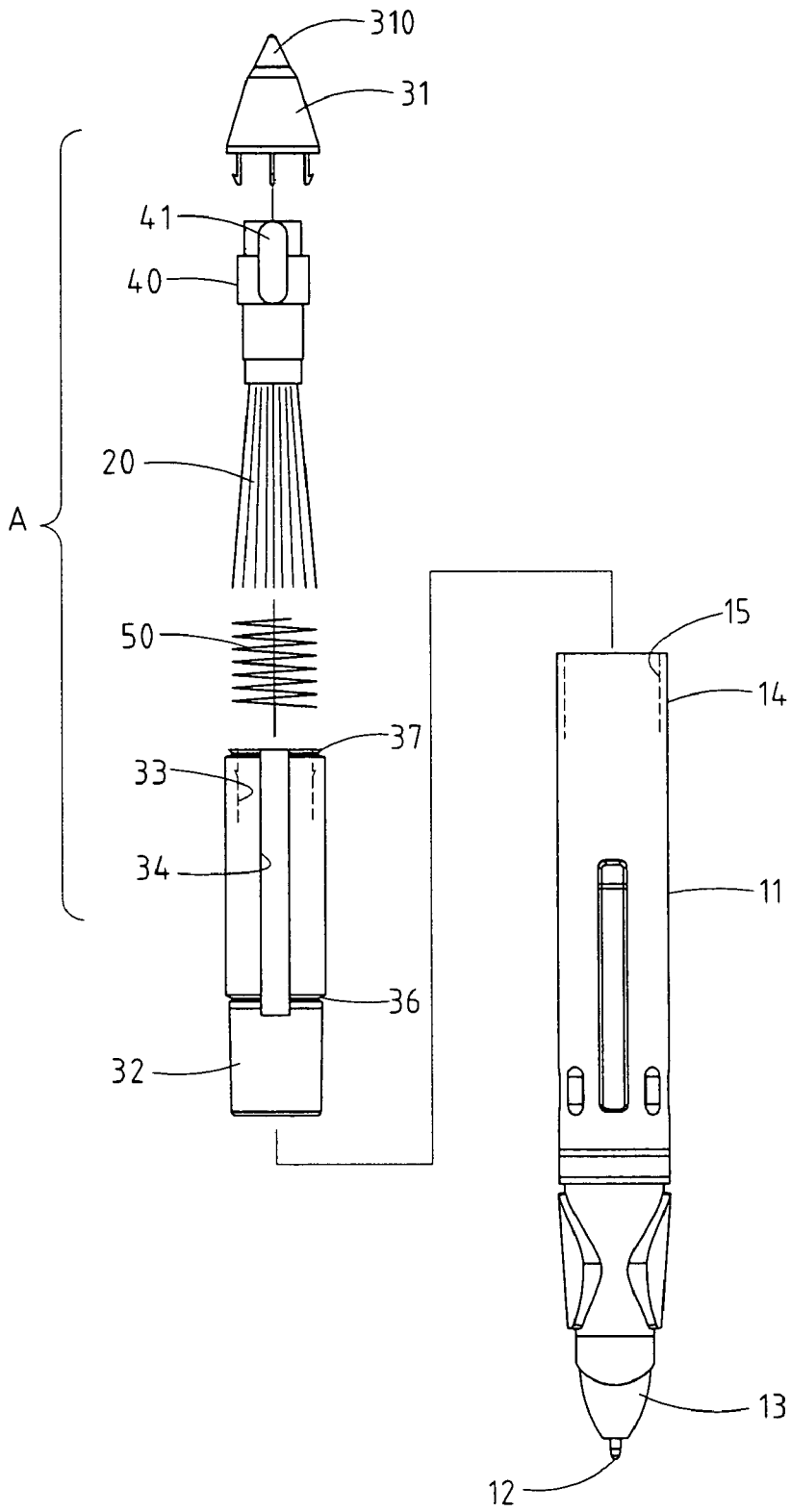
FIG. 3 shows an exploded elevation view of the preferred embodiment of the present invention.

As shown in the FIGS. 1 and 2, the extra functional end 20 of the reversible accessory A is shown in the hidden position. Under this condition, the reversible accessory A is connected to the slot 15 by the second terminal connector 32, and the inner slide 40 is pushed upward by the elastic accessory 50, which makes the extra functional end 20 become hidden.

Figure 4:
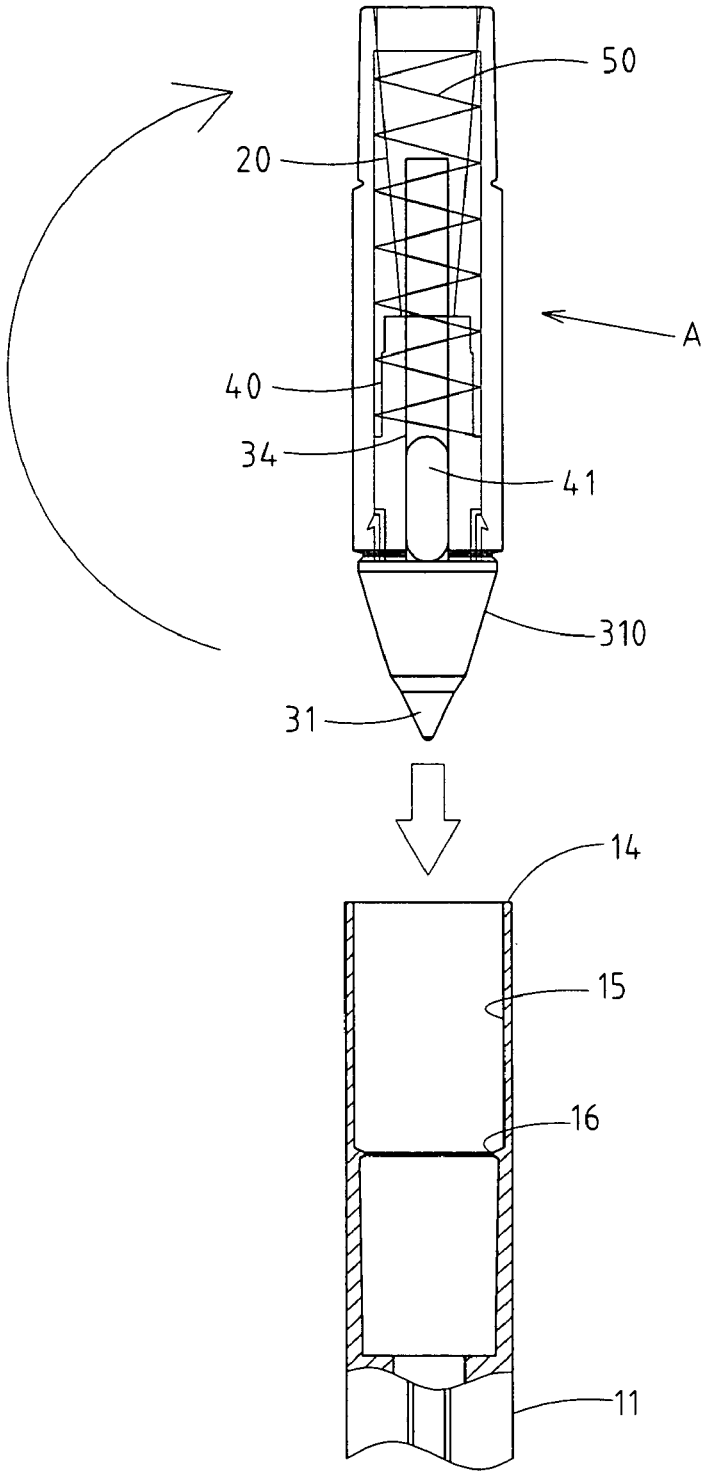
FIG. 4 shows a partial exploded elevation view of the reversible accessory inserted into the pen structure.
Figure 5:
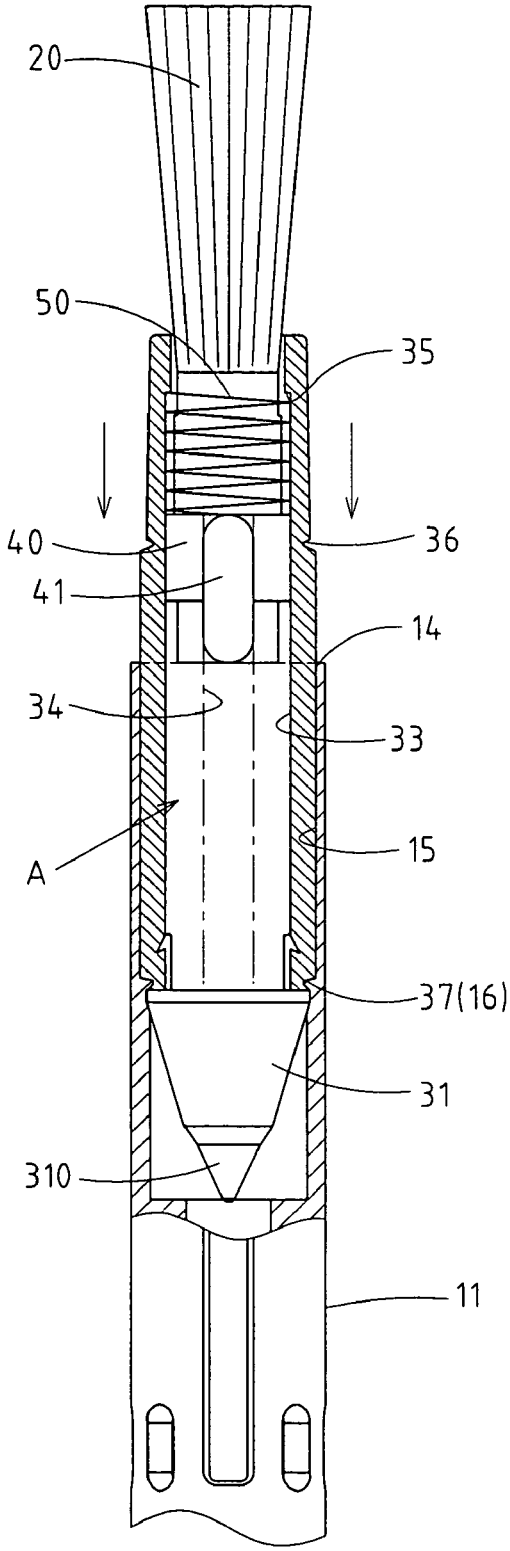
FIG. 5 shows another partial exploded elevation view of the grouping of luminous bodies in the first embodiment.
Figure 6:
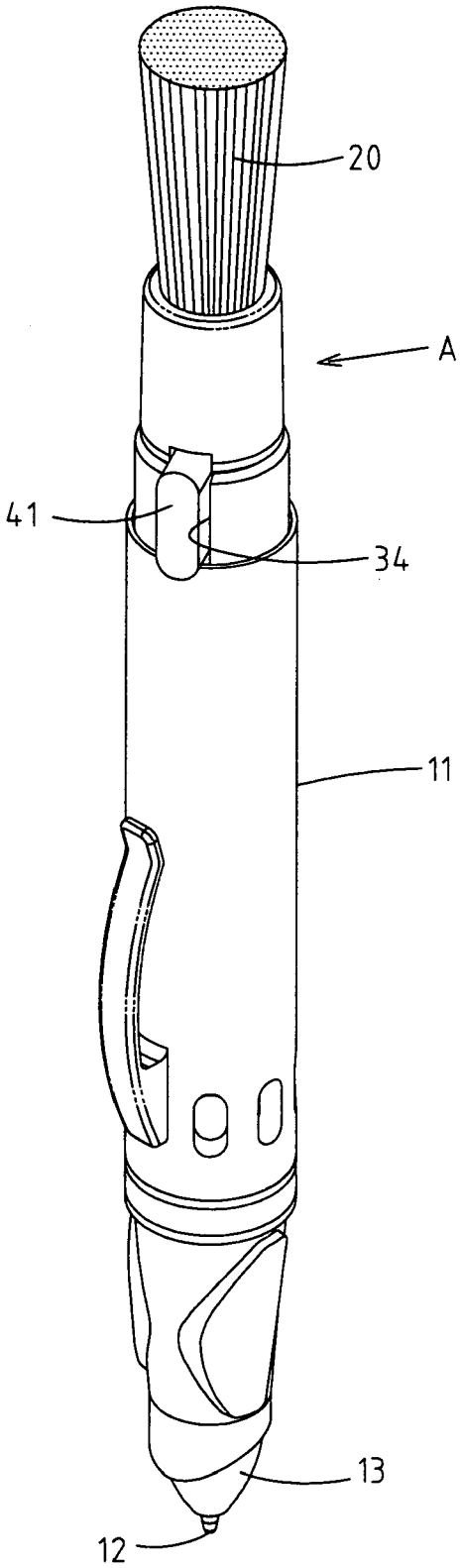
FIG. 6 shows another perspective view of the preferred embodiment of the present invention, with the extra functional end in the protruding position.

As shown in FIG. 4, when the extra functional end 20 is ready to be used, push the reversible accessory A off the slot 15 of the pen, turn it in 180°, which makes the first terminal connector 31 of the reversible accessory 20 facing the slot 15, and proceed to connect. As the first terminal connector 31 is connected to the slot 15, since the protruding button 41 is pushed against the end 14, which caused the inner slide 40 unable to descend, therefore, when the reversible accessory A is connected to the fixed position, the extra functional end 20 is in the protruding position (shown in FIG. 5).

I claim:

1. A pen comprising:

a pen body having a first end and a second end, said pen body having a slot at said first end extending into an interior of said pen body;

a ball tip extending outwardly of said second end of said pen body, said ball tip having a refill element extending outwardly therefrom;

a reversible accessory received in said slot of said pen body, said reversible accessory having a functional element at one end, said reversible accessory having a first terminal connector at said one end and a second terminal connector at an opposite end thereof, said first terminal connector and said second terminal connector engageable with said slot of said pen body such that said functional element is located within said interior of said pen body when said second terminal connector engages said slot and such that said function element extends outwardly of said interior of said pen body when said second terminal connector engages said slot, said functional element being cooperative with an elastic member in said reversible accessory, said reversible accessory having an inner slide structure, said functional element positioned at one end of said inner slide structure, said functional element having a protruding button extending through said inner slide structure, said inner slide structure having an cannular slot formed therein with a guide slot communicating with said cannular slot on one side of said inner slide structure, said protruding button slidable along said guide slot, said inner slide structure positioned adjacent said second terminal connector of said reversible accessory, said elastic member positioned adjacent a fixed point in said cannular slot so as to urge said functional element inwardly of said slide structure, said protruding button slidable along said guide slot so as to cause said functional element outwardly of said inner slide structure.

2. The pen of claim 1, said functional element selected from the group consisting of a brush, an eraser, a pen head and a tool.

3. The pen of claim 1, said functional element is a pen head detachably connected to said first terminal connector of said reversible accessory.

* * * * *